US005772361A

United States Patent [19]

Gavin

[11] Patent Number: 5,772,361

[45] Date of Patent: Jun. 30, 1998

[54] EXTENDABLE ANCHOR BASE SEPTIC TANK

[76] Inventor: Norman W. Gavin, 2545 Ridge Rd., North Haven, Conn. 06473

[21] Appl. No.: 615,344

[22] Filed: Mar. 11, 1996

[51] Int. Cl.[6] ..... E02B 11/00

[52] U.S. Cl. ..... 405/36; 52/20; 220/565; 405/52

[58] Field of Search ..... 405/52, 124–126, 405/196–208, 53, 55, 36; 52/20, 19, 169.7, 169.8; 220/565, 484, 628, DIG. 14

[56] References Cited

U.S. PATENT DOCUMENTS

| | | | |
|---|---|---|---|
| 2,589,153 | 3/1952 | Smith | 405/205 |
| 3,575,284 | 4/1971 | Holt | 206/1 |
| 3,720,064 | 3/1973 | Hall | 405/55 |
| 3,904,524 | 9/1975 | Pelton et al. | 210/94 |
| 3,946,568 | 3/1976 | Heien | 405/207 |
| 4,089,139 | 5/1978 | Moffa et al. | 52/20 |
| 4,303,350 | 12/1981 | Dix | 405/36 |
| 4,501,665 | 2/1985 | Wilhelmson | 210/630 |
| 4,635,811 | 1/1987 | Lodi | 220/69 |
| 4,663,036 | 5/1987 | Strobl | 210/170 |
| 4,872,575 | 10/1989 | Kobilan | 220/3.3 |
| 5,242,584 | 9/1993 | Hoarau | 210/170 |
| 5,333,750 | 8/1994 | McKinnon | 220/484 |
| 5,390,812 | 2/1995 | Spiro | 220/403 |
| 5,421,478 | 6/1995 | Lovato | 220/565 |
| 5,511,897 | 4/1996 | House et al. | 52/20 X |

*Primary Examiner*—Dennis L. Taylor
*Attorney, Agent, or Firm*—Robert A. Seemann

[57] ABSTRACT

A septic tank adapted for burial in soil includes a movable anchor that extends near the bottom of the tank to hold the tank in the soil.

6 Claims, 6 Drawing Sheets

EXTENDABLE ANCHOR BASE SEPTIC TANK

BACKGROUND OF THE INVENTION

1. Field of the Invention

The invention pertains to underground septic tanks, more particularly to a septic tank such as a distribution tank, fluid separator tank, and settling tank, that is adapted for burial directly in the soil, and which is light weight in construction such as one molded from plastic, in which the tank has a movable anchor that is horizontally extendable from the side of the tank.

2. Description of the Prior Art

An underground septic system generally includes a large settler/digester tank which is connected by pipe to the source of sewage, and a smaller distribution tank also called a distribution box or drop box that is connected by pipe to the settler/digester tank and to outlet pipes which extend over a large area called a leaching field where the treated sewage is deconcentrated by percolating it out over the large area.

Disruption of a pipe connection at a septic tank results in an unacceptable environmental hazard by overloading the soil locally with undigested sewage or treated effluent. Disruption of the piping can be caused by shearing off at the pipe connection with the septic tank if the tank moves within the soil.

Concrete septic tanks have a high weight-to-volume ratio that benefits stable underground installation. But, they are costly in time and equipment to make, to ship from the caster to the installation site, to handle, and to install in the ground.

A plastic septic tank is relatively inexpensive and quick to make, which saves manufacturing and inventory cost, takes less time and lower cost equipment to ship from the molder to the installation site, to handle, and to install in the ground.

Less soil needs to be removed to make room for a plastic tank than a concrete tank of equal volume because the walls of the plastic tank are thinner and overall volume is less.

The light weight of a plastic tank causes two stability problems when the tank is installed in the earth.

One problem is that the full-to-empty overall weight ratio is high, resulting in a higher full-to-empty downward settling force ratio for the plastic tank than for a concrete tank of equivalent liquid volume.

Another problem is that a partially empty tank may be forced out of the earth by a rise in water level in the soil from heavy rain, as buoyancy of the tank overcomes the weight of the tank and grip of the tank by the soil.

U.S. Pat. No. 3,904,524, patented by Pelton et al., Sep. 9, 1975, describes several items and methods for attacking the problem in a light weight oil separator tank adapted for underground burial that is made with a foam and fiberglass reinforced skin over a frame.

In one method, a standpipe mounted below a covered observation opening in the top of the tank extends through the bottom of the tank. Height of ground water in the pipe provides visible indicia of the buoyant force which the soil water may impose against the bottom of the tank.

In another method, a divider wall within the tank is made higher to increase the height of water in a separating chamber in the tank to increase the downward force within the tank.

In another method, ground water is allowed to come into the tank by rising up the standpipe when the ground water pressure is otherwise sufficient to force the tank out of the ground, to increase the downward force within the tank.

In another method the bottom wall of the tank extends fixedly horizontally beyond the tank on all four sides of the rectangular tank to act as an anchor in the soil. Gussets are interposed between vertical studs of the frame and the horizontal bottom wall during construction of the tank to strengthen the construction.

SUMMARY OF THE INVENTION

It is one object of the invention to provide a soil anchor for a septic tank.

It is another object that the anchor is retractable and extendable from the tank.

It is another object that the tank is stackable when the anchor is retracted.

It is another object that the anchor is retractable and extendable from the tank by means of a hinge between the tank and anchor.

It is another object that the tank, anchor and hinge be integrally molded.

It is another object that the hinge be a living hinge that is a molded part of the tank.

It is another object that the integral hinge be a living hinge that is a molded part of the tank and the anchor.

It is another object that the anchor resists sinking of the tank in the soil.

It is another object that the anchor resists rising of the tank in the soil.

Other objects and advantages of the invention will become apparent to persons skilled in the art from the ensuing description.

In a septic tank adapted for burial in soil and having an aperture in the tank adapted for receiving pipe, the improvement comprises the septic tank being molded from a material comprising plastic, anchor means adapted for holding in soil, and means mounting the anchor means on the tank so that the anchor means is movable toward and away from a vertical line in the tank, extendable generally horizontally from the tank, retractable toward the vertical line, and movable from a generally vertical position to a generally horizontal position.

Preferably the means mounting the anchor means is at the bottom of the tank, and comprises hinge means connected to the tank and anchor means.

In a preferred embodiment the means mounting the anchor means is a living hinge being a molded part of the tank.

A method for burying a septic tank in soil comprises moving an anchor mounted on the tank at the bottom end of the tank, from a position close to the tank to a horizontally extended position with respect to the tank, and depositing soil on the anchor. The moving of the anchor may be in an arc, and may be between vertical and horizontal positions of the anchor.

BRIEF DESCRIPTION OF THE DRAWINGS

In order that the invention be more fully comprehended, it will now be described, by way of example, with reference to the accompanying drawings, in which.

DESCRIPTION OF THE PREFERRED EMBODIMENTS

Figure 1:
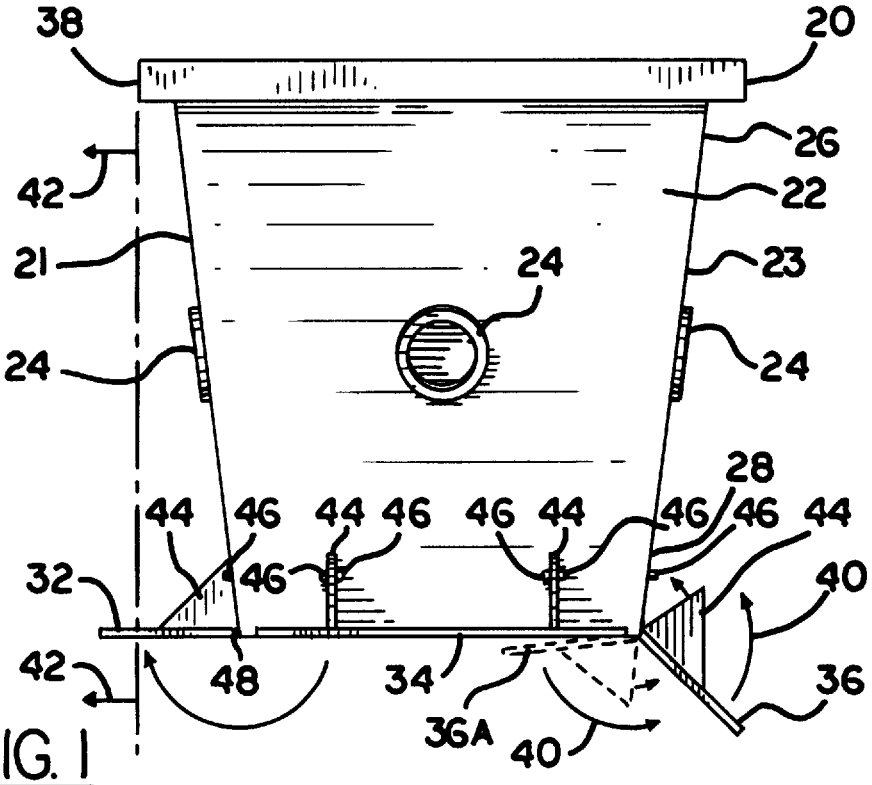
FIG. 1 is a front view of a septic tank adapted for underground installation in soil according to invention.

Before explaining the invention in detail, it is to be understood that the invention is not limited in its application to the detail of construction and arrangement of parts illustrated in the drawings since the invention is capable of other embodiments and of being practiced or carried out in various ways. It is also to be understood that the phraseology or terminology employed is for the purpose of description only and not of limitation.

Figure 2:
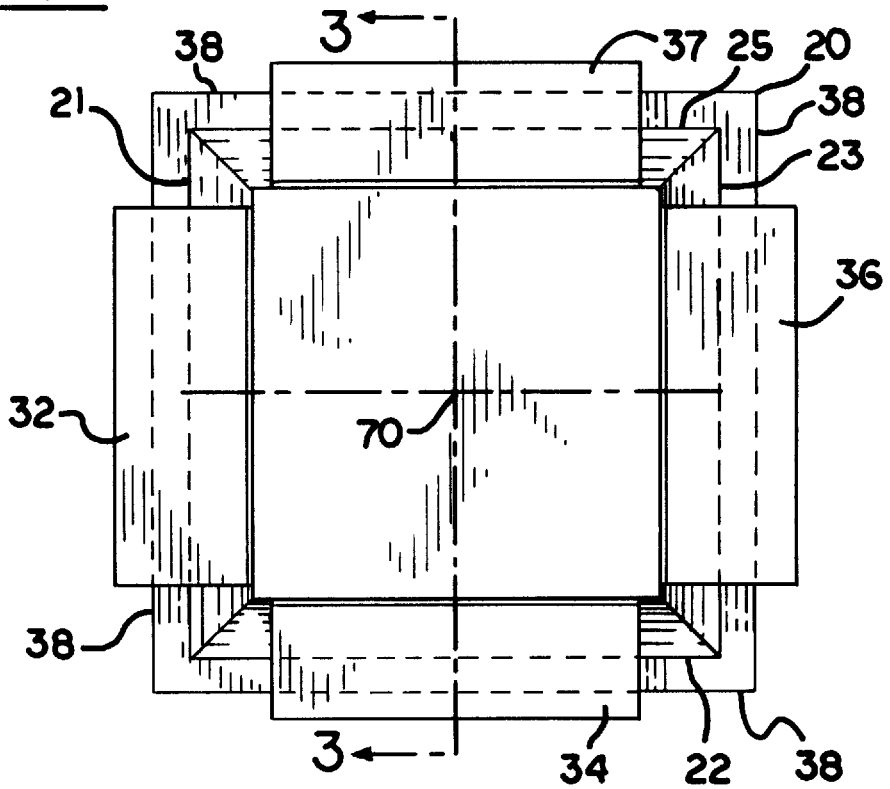
FIG. 2 is a bottom view of the septic tank of FIG. 1.
Figure 3:
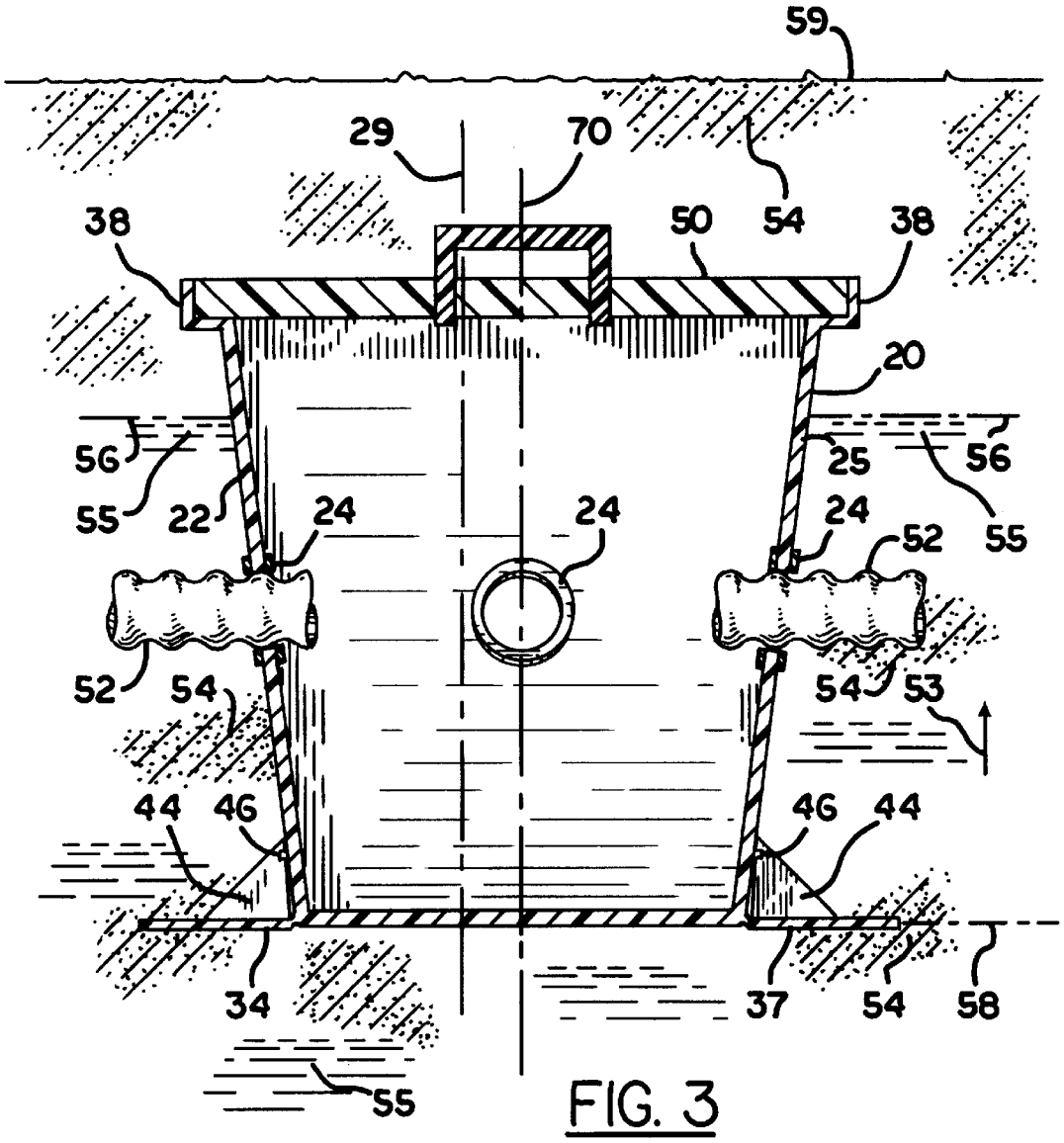
FIG. 3 is a cross section view of the septic tank of FIG. 1, viewed along 3—3. The tank is shown sealed with a cover, connected to septic system pipe, and buried in soil.

In FIGS. 1, 2, and 3, septic system distribution tank 20 includes integral seals 24 for receiving septic pipe.

The tank is plastic, and slopes down from being wider at the top 26 than at the bottom 28. It is preferably has four sides, 21, 22, 23, and 25.

Stability for maintaining the tank upright in a hole, often on relatively soft soil, is provided by four anchor plates, 32, 34, 36, and 37. The anchor plates are movable toward and away from vertical line 29, which is within the tank. Vertical line 29 can be anywhere in the tank, but preferably is near or at the center of the tank. Each anchor plate when at maximum horizontal extension from the tank, extends preferably as far 42 as the outer edge 38 of the top 26 of the tank.

The anchor plate is preferably integrally molded with the tank, that is, molded with the tank as a unit. It is also preferred that each is attached to the tank by a living hinge 48 that preferably is a molded part of the tank and the anchor.

The plates are shown in various stages of deployment. Plate 36 is shown about half deployed from the storage position 36A shown in dashed lines. 36A is the position at which all the plates are provided when tank 20 is molded and shipped nested with other tanks 20.

Before installation in a hole, plate 36 is rotated 40 until brace wall 44 engages and is held by grip protrusions 46, as shown on plates 32 and 34. Preferably grip protrusion 46 and brace wall 44 are also molded parts of the tank and anchor.

In FIG. 3, septic tank 20 in cross section is shown sealed with cover 50, connected to septic system pipe 52, and buried in soil 54.

Septic tank 20 is buoyed up 53 by ground water 55 which tops off at level 56. When the combination of full tank and lower water level occurs, as with changes in sewage delivery, weather, and season, where tank 20 is full of sewage, and the level of ground water drops, the tank is forced by the weight of the sewage in a downward direction into the soil. If tank 20 was to settle significantly under the weight of the sewage a shearing force would be put on pipe 52 and seal 24 that would cause the seal to leak or the pipe to rupture. This is unacceptable.

Damage of the seal and pipe is prevented by the anchor plates which lock in the soil and prevent significantly harmful settling of the tank.

When the tank is first laid on a bed of soil at level 58 before earth is added to cover the tank to level 59, the anchors support the tank vertically against tipping over into the soil by providing a wider support base for the tank. Brace walls 44 provide sufficient stiffness for the anchors to handle the task.

The wider, stiff, support base provided by the anchors is important because installation of the pipes applies multidirectional forces on the tank, and shifts it on the base where it would dig into the soil at various angles. The upward support force provided by the anchors resting uncovered on the soil at level 58 prevents digging in, tilting and sinking of the tank.

As the soil is back filled on level 58, over the tank, the soil first falls on the anchors and vertical brace walls 44. The soil building up on the anchors further stabilizes the vertical orientation of the tank so that higher levels of soil which do not always build evenly about a tank during back fill do not tilt the tank.

The vertical brace walls anchor the tank against rotation about vertical axis 70.

The horizontally extendable and retractable anchors provide upward and downward anchoring force before, during, and after burying the tank in the soil.

Figure 4:
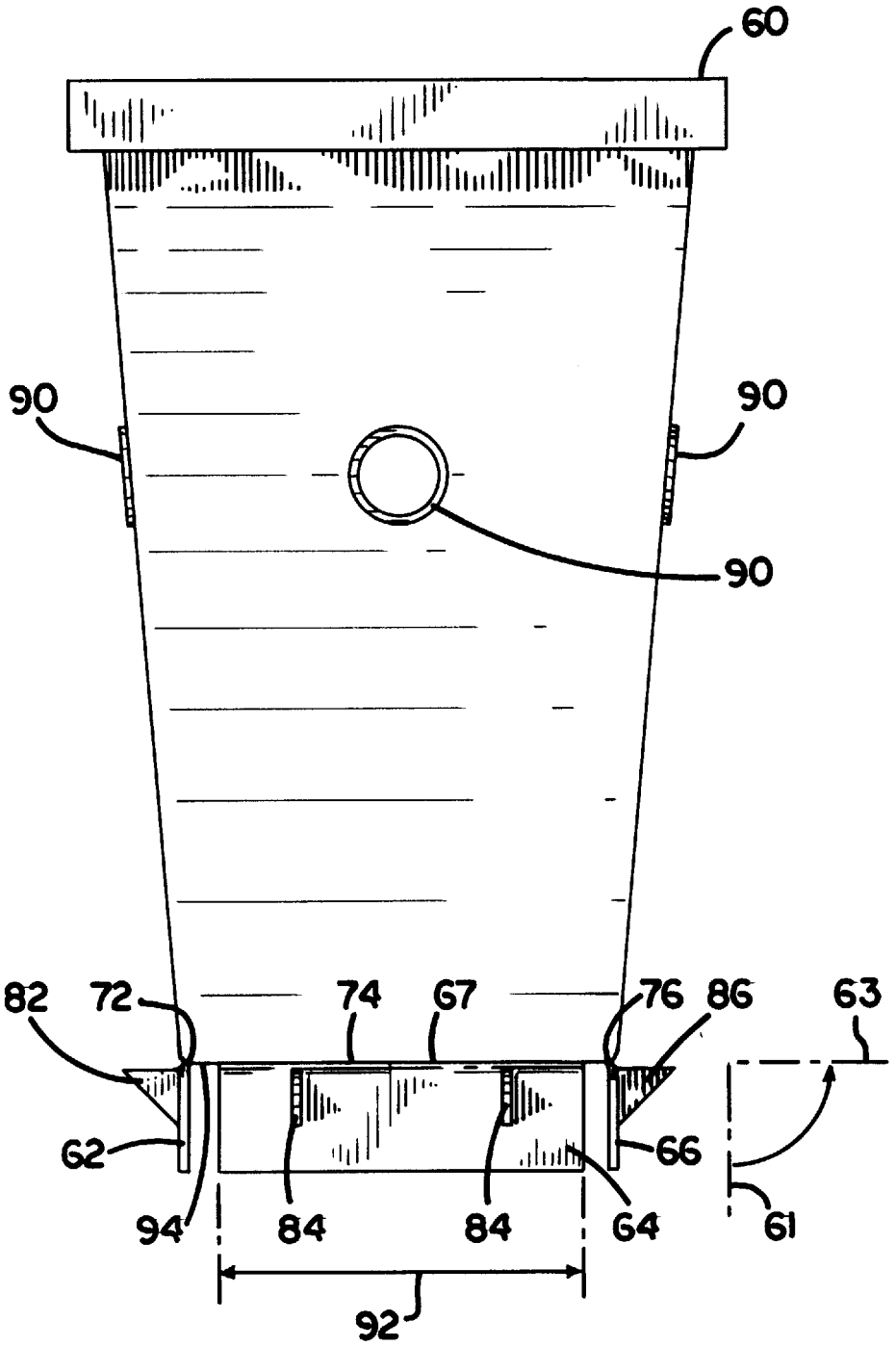
FIG. 4 is a front view of another septic tank of the invention.
Figure 5:
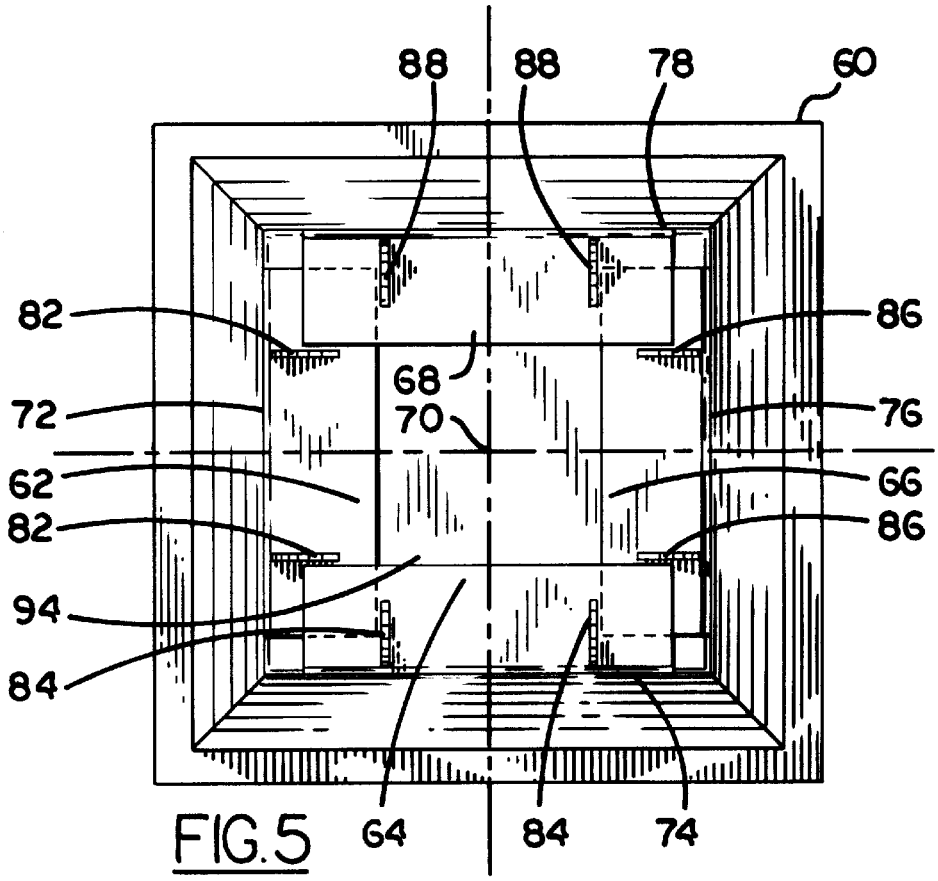
FIG. 5 is a bottom view of the septic tank of FIG. 4.

In FIGS. 4 and 5, septic tank 60 is molded in one piece, of plastic, including anchors 62, 64, 66, and 68, their respective integral hinges 72, 74, 76 and 78, and brace walls 82, 84, 86 and 88.

Septic tank 60 includes pipe seals 90 fastened on the tank in a separate operation from the molding.

The position of the hinge, width 92 of the anchor along the hinge, and location of brace wall on the hinge is such that the anchors can be retracted by being folded over bottom 94 of the tank sufficiently to allow insertion of tank 60 into the top of another tank 60 without interference from the anchors or the brace walls for nesting for storage and shipping. When fully retracted, essentially all of each anchor is under bottom 94.

Anchors 62, 64, 66, and 68 can be moved on hinges 72, 74, 76, and 78 from vertical position 61 to horizontal position 63. When in horizontal position 63, the anchors are generally coplanar with support base 67 of tank 60.

Figure 6:
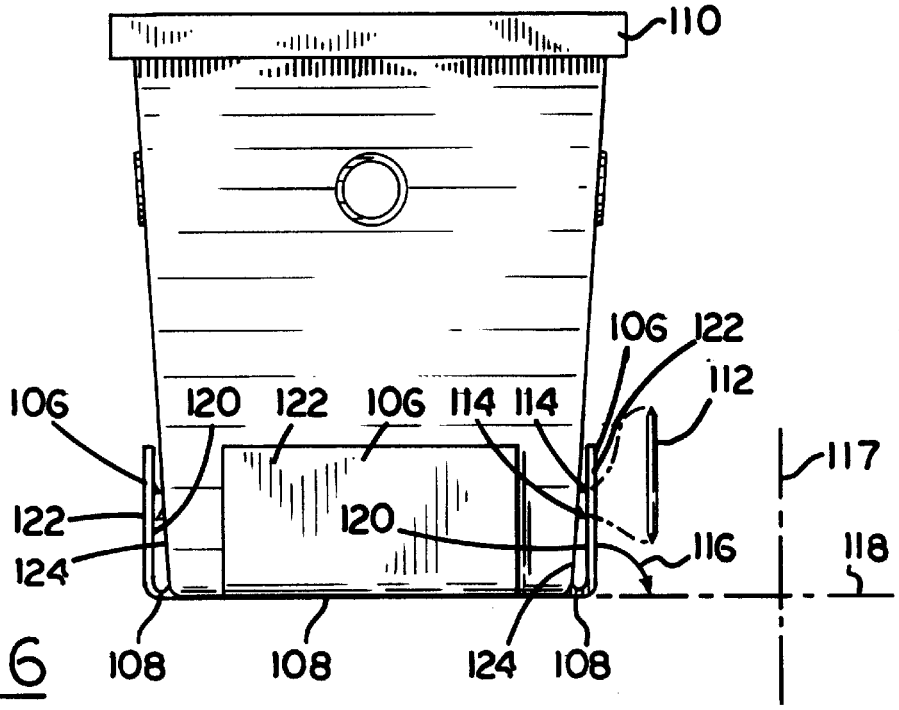
FIG. 6 is a front view of another septic tank of the invention.

In FIG. 6, anchors 106 of septic tank 110 are attached by living hinges 108 which are molded on tank 110. Removable brace 112 is inserted in catches 114 when anchors 106 are rotated 116 from vertical position 117 to horizontal position 118.

When an anchor 106 is fully extended horizontally from the tank and buried in soil, the soil impacted about the anchor on top side 120, bottom side 122, and within the adjacent region between the top of the anchor and lower side 124 of the tank, the triangular wedge of soil holds the anchor stiff and prevents rotation of the anchor toward the lower side of the tank. The horizontally extendable and retractable anchor 106 of tank 110 thereby provides upward and downward anchoring force during, and after burying the tank in the soil.

When anchor 106 is rotated to the horizontal, and removable brace 112 is inserted in catches 114, the horizontally extendable and retractable anchor 106 of tank 110 provides upward and downward anchoring force upon seating of the tank at the bottom of a hole in the soil before back fill. It thereby provides upward and downward anchoring force before, during, and after burying the tank in the soil.

Figure 7:
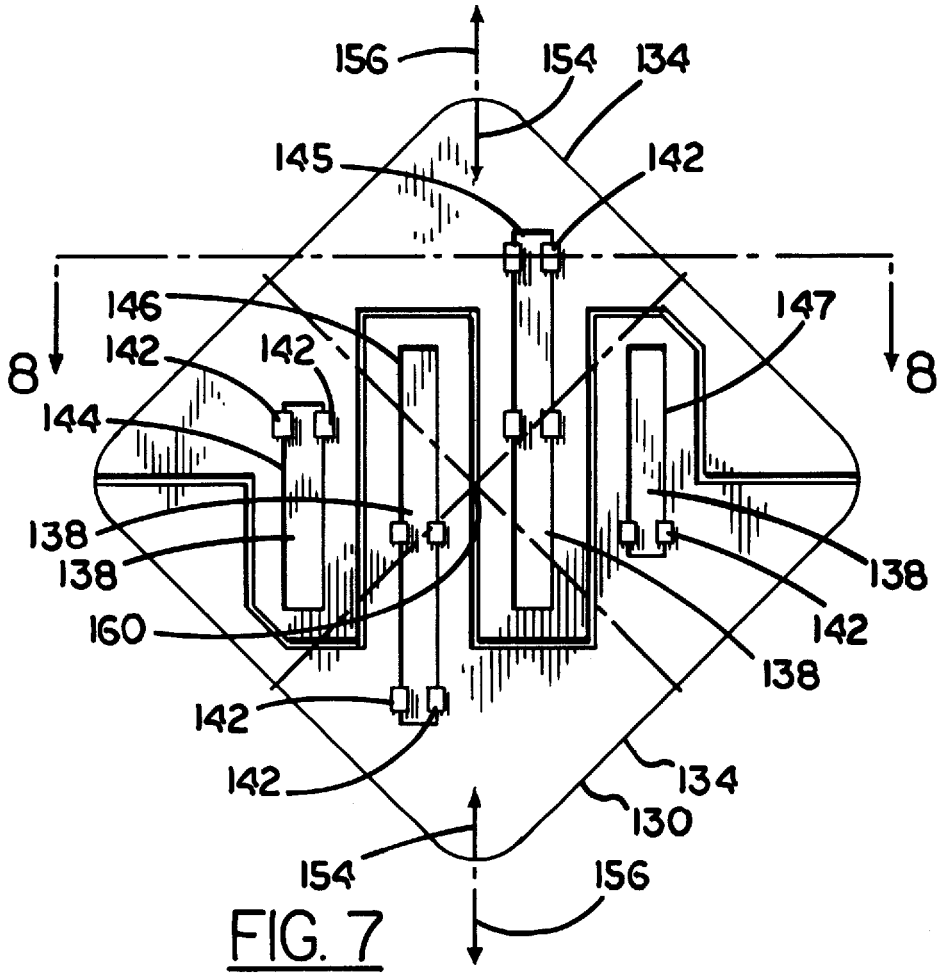
FIG. 7 is a bottom view of another septic tank of the invention.
Figure 8:
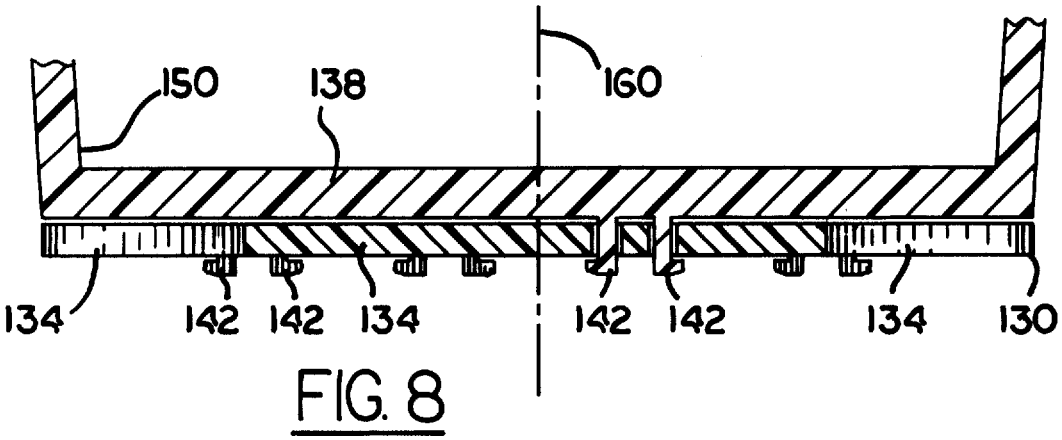
FIG. 8 is a sectional front view of the septic tank of FIG. 7 viewed along line 8—8.

In FIGS. 7 and 8, septic tank 130 anchors 134 are slidably mounted on bottom wall 138 of the tank by springy retainer clips 142 which are preferably an integral part of and molded with wall 138. After container portion 150 of the tank, including bottom wall 138 is molded with integral clips 142, anchors 134 are snapped onto the clips by way of slots 144, 145, 146, and 147, adjacent to wall 138.

Anchors 134 are mounted by retainer clips 142 on wall 138 so that anchors 134 can slide generally parallel to wall 138, toward 154, and away 156, from vertical line 160 which is within the tank. Anchors 134 are extendable horizontally in direction 156, and may be retracted so that the anchors are under wall 138, parallel to wall 138, and preferably with all of each anchor being under the wall when they are fully retracted. This allows insertion of one tank 130 into the top of another tank 130 without interference from the anchors.

Figure 9:
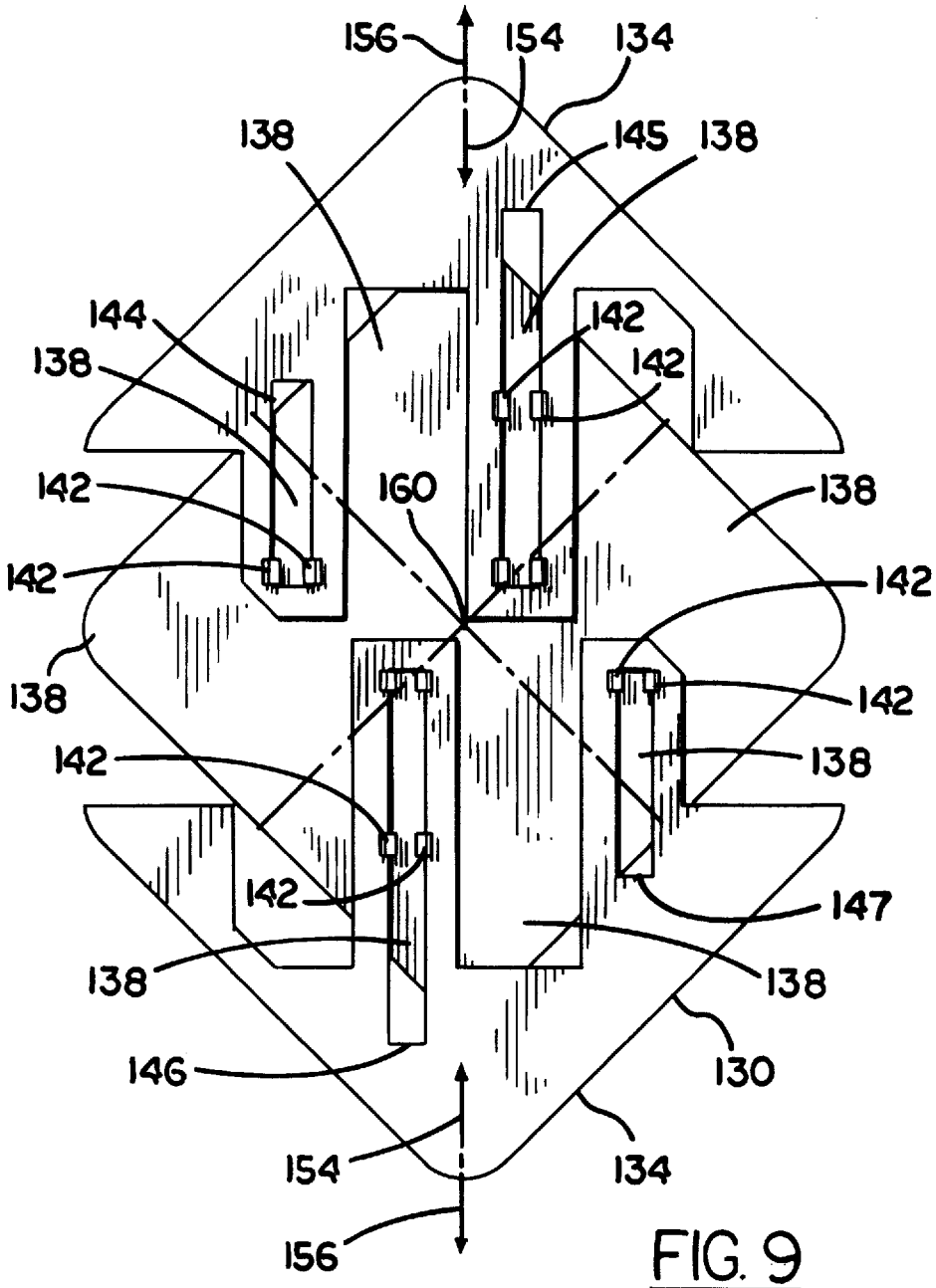
FIG. 9 is a bottom view of the septic tank of FIG. 7.

In FIG. 9, anchors 134 are fully extended horizontally from the tank. They provide upward and downward anchoring force upon seating of the tank at the bottom of a hole when they are covered with soil.

Although the present invention has been described with respect to details of certain embodiments thereof, it is not intended that such details be limitations upon the scope of the invention. It will be obvious to those skilled in the art that various modifications and substitutions may be made without departing from the spirit and scope of the invention as set forth in the following claims.

What is claimed is:

1. A molded plastic septic tank adapted for burial in soil, comprising:

a top, a bottom, a vertical line within said tank, a generally horizontal bottom first wall, a generally vertical second wall extending from said top and attached to said first wall an arm and hinge integrally molded with said tank at the bottom of said tank so that said arm is rotatable by said hinge on said tank toward and away from said vertical line, rigid brace means connected to said arm and said second wall configured to prevent upward rotation of said arm to said second wall.

2. The septic tank of claim 1, further comprising:

an aperture in said tank spaced from said top and from said bottom of said tank and a seal on said aperture adapted for receiving septic system underground pipe.

3. The septic tank of claim 1, further comprising:

said arm being rotatable under said first wall.

4. The septic tank of claim 1, further comprising:

said brace means being integrally molded with said tank.

5. A molded plastic septic tank adapted for burial in soil, said septic tank having a top, a bottom, and comprising an anchor element slidably mounted on said bottom wall under said tank that is movable from a first position close to said tank, to a second position further from said tank than said first position so as to anchor said tank in soil when said tank is buried in the soil, said anchor element comprising a pair of opposed tandem plates for anchoring said tank in soil when said tank is buried in the soil, each plate comprising a pair of slots for slidably receiving clips adapted for holding said plate on the bottom of said bottom wall.

6. The septic tank of claim 1, further comprising:

gripping means integrally molded with said tank, configured to keep said brace means positioned between said second wall and said arm to prevent upward rotation of said arm to said second wall.

* * * * *